United States Patent [19]

Murphy

[11] Patent Number: 4,706,313

[45] Date of Patent: Nov. 17, 1987

[54] DECUBITUS ULCER MATTRESS

[75] Inventor: Mike Murphy, LaCrescent, Minn.

[73] Assignee: Comfortex, Inc., Winona, Minn.

[21] Appl. No.: 857,977

[22] Filed: May 1, 1986

[51] Int. Cl.[4] ..... A47C 27/15; A61G 7/04

[52] U.S. Cl. ..... 5/464; 5/470; 5/481; 5/473

[58] Field of Search ..... 5/465, 464, 481, 470, 5/471, 473

[56] References Cited

U.S. PATENT DOCUMENTS

| | | | |
|---|---|---|---|
| 389,420 | 9/1888 | Sutton . | |
| 934,465 | 9/1909 | Rust . | |
| 1,040,795 | 10/1912 | Skeffington . | |
| 1,276,361 | 8/1918 | Hobert . | |
| 1,548,728 | 8/1925 | Milam | 5/465 |
| 3,027,573 | 4/1962 | Bell | 5/470 |
| 3,058,124 | 10/1962 | Sturtevant | 5/450 |
| 3,146,469 | 9/1964 | Slade | 5/465 |
| 3,451,071 | 6/1969 | Whiteley . | |
| 3,574,873 | 4/1971 | Weinstein | 5/450 |
| 3,626,526 | 12/1971 | Viel | 5/465 |
| 3,639,927 | 2/1972 | Munch | 5/465 |
| 3,742,528 | 7/1973 | Munch | 5/465 |
| 3,828,377 | 8/1974 | Eary, Sr. | 5/436 |
| 3,846,857 | 11/1974 | Weinstock | 5/464 |
| 3,939,508 | 2/1976 | Hall et al. | 5/464 |
| 4,292,703 | 10/1981 | Goguen | 5/468 |
| 4,327,714 | 5/1982 | Spann | 5/443 |
| 4,628,557 | 12/1986 | Murphy | 5/464 |

FOREIGN PATENT DOCUMENTS

| | | | |
|---|---|---|---|
| 550815 | 12/1957 | Canada | 5/470 |
| 8004755 | 3/1982 | Netherlands | 5/481 |
| WO81/02384 | 9/1981 | PCT Int'l Appl. | 5/465 |

OTHER PUBLICATIONS

"Ticking '84", an article in the Apr. 1984 Issue of Bedding Magazine.

*Primary Examiner*—Alexander Grosz
*Attorney, Agent, or Firm*—Oblon, Fisher, Spivak, McClelland & Maier

[57] ABSTRACT

A mattress consists of a foam body having recesses at positions corresponding to the locations of protruding portions of a patient lying on the mattress. Foam blocks can be selectively placed in portions of the recesses. An encasement member encases the foam body and includes a top foam sheet. A bloused waterproof, non-shearing, flame retardant and antibacterial top sheet forms a portion of the encasement member covering the foam sheet. A zipper in the encasement member enchances air circulation into and out of the mattress.

13 Claims, 2 Drawing Figures

DECUBITUS ULCER MATTRESS

BACKGROUND OF THE INVENTION

1. Field of the Invention

The present invention relates to a mattress having utility in the prevention and treatment of decubitus ulcers and other tissue damage aggrevated by pressure, and/or heat, and/or shearing.

2. Related Art

Decubitus ulcers are caused by the reduction or lack of blood to skin and muscle tissue. The deprived cells quickly die and sores form. These sores often become open wounds which can spread throughout the body's soft tissue and finally expose bone mass. Predisposing conditions which contribute to the formation of decubitus ulcers include circulatory disease and the exposure of tissue to extreme temperatures, as well as shearing, i.e., friction against the skin, which can stretch and close blood vessels. A major cause of decubitus ulcers, however, is pressure.

For example, when an individual lies in a given position for an extended period of time, protrusions in the skeletal structure, such as at the back of the head, the buttocks and the heels, cause the soft tissue covering these portions of the skeletal structure to be squeezed against an underlying support surface, such as a mattress. This soft tissue is squeezed and the blood flow therein altered, and so such tissue is especially susceptible to decubitus ulcers. The position and spacing of these relatively small and localized pressure points vary from individual to individual.

Efforts have been made to design mattresses which minimize the possibility of decubitus ulcers. An example may be found in U.S. Pat. No. 3,742,528 to Munch. There, a foam frame is cemented to a rigid base and includes a central cut out. Inserts may be placed in the central cut out while other portions of the cut out are left open so that the mattress can be shaped to relieve local pressure on the body of the patient. However, this mattress cannot be used on an adjustable bed frame and the crevices created by the cut out and inserts make cleaning difficult. A person lying on the mattress will also tend to experience the uncomfortable sensation of "dropping into a hole," and the edges around the empty portions of the cut out can create a "cookie cutter effect" on portions of the patient lying thereon as the body presses against the mattress surface. Another source of discomfort is derived from the relatively high friction coefficient of the foam mattress which tends to shear against a patient's skin as the patient descends into the mattress.

U.S. Pat. No. 3,146,469 to Slade also discloses a mattress having cut outs for conforming to a body shape, in order to reduce the possibility of bed sores. There, a mattress is mounted on a plurality of wooden slats and is made of a foam material entirely encased by waterproof vinyl. Cut outs in the mattress may be filled with correspondingly shaped blocks. However, this mattress does not reduce heat build-up, which increases the susceptibility of skin damage or breakdown. Moreover, the cleaning, comfort and shear problems associated with Munch will also arise in Slade.

SUMMARY OF THE INVENTION

It is the object of the present invention to provide a decubitus ulcer mattress which can selectively eliminate the pressure-creating surfaces in juxtaposition to pressure-sensitive body parts.

It is a further object of the present invention to provide a decubitus ulcer mattress that offers selective pressure relief that can be changed to different body locations for patients of varying sizes and shapes.

It is a further object of the present invention to provide a decubitus ulcer mattress with selectively removable sections that are secured in place without the use of mechanical or adhesive means.

It is a further object of the present invention to provide a decubitus ulcer mattress which can be accommodated on an adjustable bed frame.

It is a further object of the present invention to provide a decubitus ulcer mattress which is easily cleaned.

It is a further object of the present invention to provide a decubitus ulcer mattress which is reusable for different patients.

It is a further object of the present invention to provide a decubitus ulcer mattress which provides passive air flow directly beneath the top cover, preventing heat build-up under the patient's skin.

It is a further object of the present invention to provide a decubitus ulcer mattress which does not create a "cookie cutter effect" on the patient's skin.

It is a final object of the present invention to provide decubitus ulcer mattress which does not create shear stress on a patient's skin.

These and other objects of the invention are provided by a mattress in the form of an open-celled foam body having recesses in a top surface thereof, the recesses being positioned at locations of protruding portions of a patient lying on the mattress. The recesses may be selectively filled with foam block bodies at such locations that for a given patient, the recesses remain unfilled at locations corresponding to the protruding portions of that patient. The foam block bodies are not glued or otherwise permanently fixed within the mattress but are instead held in place by the naturally high friction properties of the surrounding open-celled foam. The mattress is preferably parallelipiped shaped and the recesses preferably do not extend entirely through the thickness of the mattress, and so have foam bottoms.

The foam mattress body is entirely encased within an encasement member. The encasement member has fabric sides and bottom, and has a top including a foam sheet covering the top surface of the foam mattress body and being laterally secured to the upper side panel. The foam sheet prevents the patient from experiencing a feeling of "falling into a hole" at the locations of the recesses which are not filled with foam blocks, eliminates discomfort that might otherwise be caused by the inherent wrinkling of the top sheet, reduces overall pressure even with cubes in place, and also distributes the pressure from the edges of the foam block bodies adjacent the recess so that the "cookie cutter effect" can be avoided.

The foam sheet is in turn covered by an oversized top sheet of waterproof, non-reflective, non-shearing, flame retardant, anti-bacterial fabric. This thin fabric absorbs and conducts radiated body heat to the foam sheet, which acts as a plenum to vent such heat through the zipper, reducing heat to skin tissue. The top sheet is impervious to urine, spilled liquids, and sweat, protecting the mattress body. This avoids the cleaning problems arising due to numerous crevices, which was experienced in the prior art.

In order to avoid shearing of the patient's skin, the waterproof, non-reflective, non-shearing, flame retardant and antibacterial top sheet, which has a lower coefficient of friction than does foam, is "bloused". That is, the top sheet has has a larger dimension than does the foam sheet and upper side panel to which it is attached at its lateral edges, and so is loosely held onto the top of the mattress. Therefore, if a patient moves or sinks into the mattress, any shearing force which might otherwise arise is absorbed by sliding between the top sheet and the underlying foam sheet.

Separating upper and lower side panels of the encasement member is a zipper. The zipper gives access for removal of the foam blocks from the encasement member so that the number and position of the foam block bodies within the recesses may be varied. The zipper, which is not air tight, also provides air ventilation. For example, patient movement on the mattress and selectively compresses and releases pressure on different parts of the mattress body, portions of the mattress body will selectively expand and contract, thus forming a bellows effect by which air is pumped into and out of the mattress through the zipper, thereby replenishing the fresh air and removing excess heat through the material of the top sheet, preventing a sweaty condition which will lead to the loss of skin integrity.

BRIEF DESCRIPTION OF THE DRAWINGS

Various other objects, features and attendant advantages of the present invention will be more fully appreciated as the same becomes better understood from the following detailed description when considered in connection with the accompanying drawings in which like reference characters designate like or corresponding parts throughout the several views and wherein.

DETAILED DESCRIPTION OF THE PREFERRED EMBODIMENT

Figure 1:
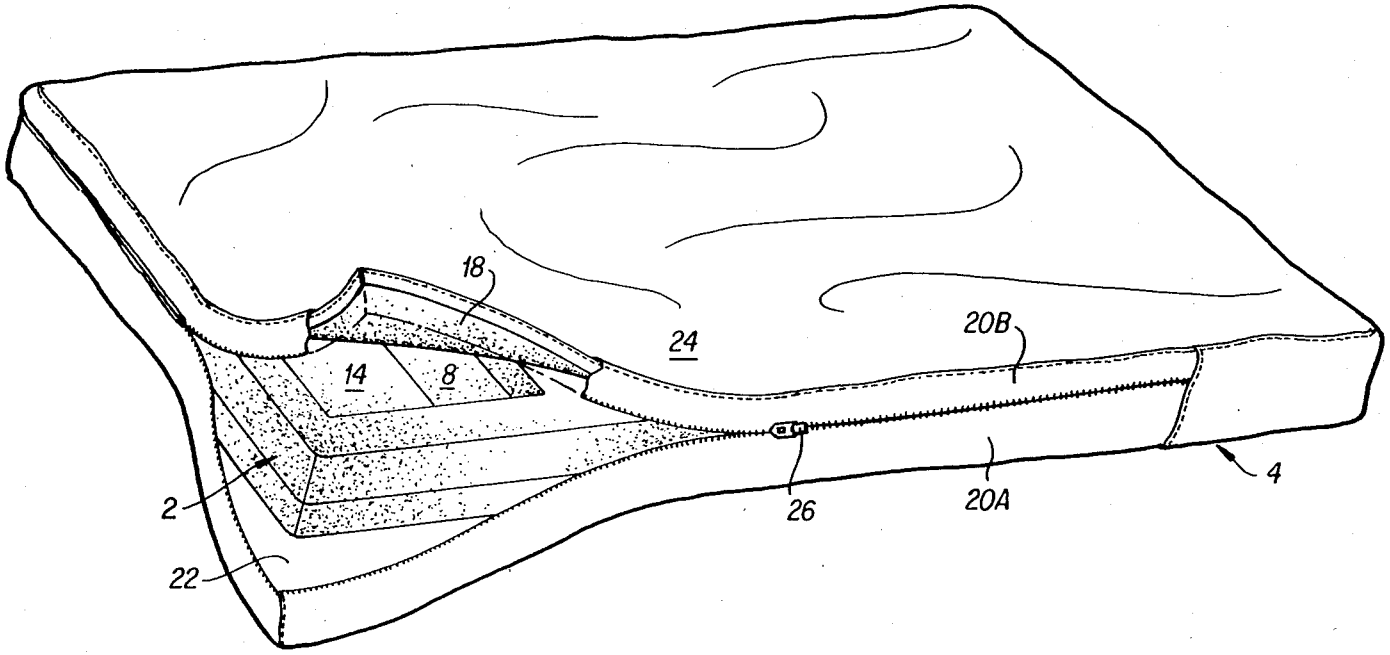
FIG. 1 is an orthogonal view of the mattress with the zipper partially opened.
Figure 2:
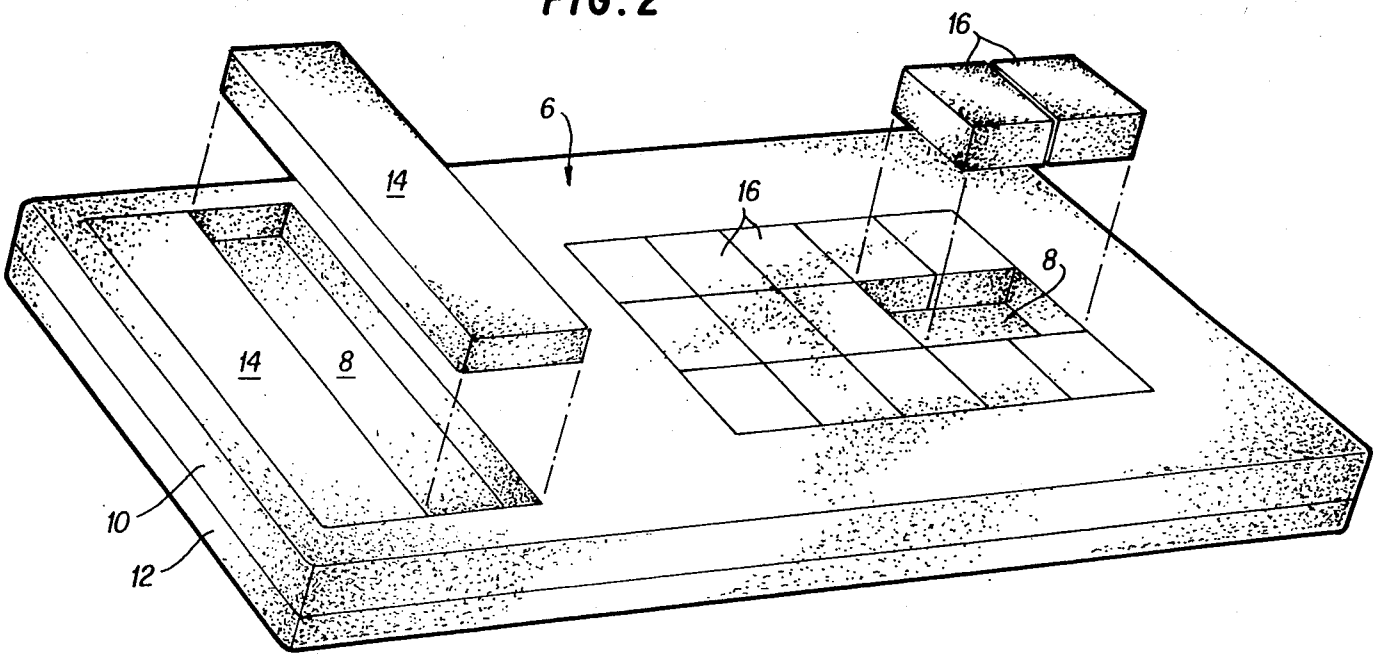
FIG. 2 is an orthogonal view of the mattress with the encasement member removed.

As best seen in FIG. 1, the mattress consists of a rectangular foam body 2 which is encased within an encasement member 4. The foam body is preferably formed of 5 inch thick polyurethane foam having 1.8 pound per cubic foot density and 35 ILD firmness and is sized so as to fit a conventional adjustable bed frame. The foam body 2 has a substantially flat top surface 6 within which are formed a number of essentially rectangular recesses 8. The recesses do not extend entirely through the foam body, and so have bottoms formed of the same material as the foam body. A preferred manufacturing technique for fabricating the recesses is to form the foam body of two layers 10 and 12. For example, the layer 10 can be 3 inches thick and the layer 12 can be two inches thick. Cut outs are then cut entirely through the thickness of the layer 10 at positions corresponding to the recesses 8, after which the layers 10 and 12 are joined by adhesive. This results in a unitary foam body 2 in which the top surface of the layer 12 forms the bottom of each of the recesses 8.

Since patients of different sizes and body shapes must use the same mattress, the recesses 8 are positioned on the mattress at locations which generally correspond to protruding portions of such patients, but have an area corresponding to a wide range of patient sizes. Block bodies 14 and 16 can then be placed at desired locations within the recesses according to the specific body shape characteristics of the patient who will be lying upon the mattress. The block bodies 14 and 16 are formed of a foam having the same composition as the foam body 2, and have the same height as the depth of the recesses 8, so that when the block bodies 14 and 16 are positioned within the recesses, the top surfaces thereof are substantially coplanar with the top surface 6 of the foam mattress body. The block bodies 14 and 16 are not secured within the recesses by adhesive, but are instead held in place by the naturally high friction existing between adjacent contacting open cell foam surfaces. The block bodies are, of course, sized so that they closely abut adjacent block bodies and completely fill the recesses, except for those areas where block bodies are intentionally left out.

The encasement member 4 includes a foam sheet 18 which lies directly atop the top surface 6 of the foam body. The foam sheet 18 is formed of relatively soft polyurethane foam having 1.0 pound per cubic foot density and a 15 ILD firmness. The foam sheet 18 preferably has a 1 inch thickness.

Lateral edges of the foam sheet 18 are secured, as by sewing, to the upper side panel 20B of the encasement member. Both the upper 20B and lower 20A side panels are preferably formed of nylon reinforced vinyl and are shaped to closely conform to the sides of the body 2. A bottom panel 22 is sewn to the lower side panel and closely conforms to the shape of the bottom of the foam body 2. The result is an encasement member which closely and securely holds the foam body 2 therein, and so retains the shape of the foam body 2.

The encasement member also includes a top sheet 24 formed of a waterproof, non-reflective, non-shearing, flame retardant and antibacterial material such as a 70 denier taffeta laminated to nylon or polyester tricot treated with an agent such as K-Kote FR (registered U.S. trademark), which is a flame retardant, fungicidal, waterproof urethane. The top sheet 24 is sewn at its lateral edges to the foam sheet 18 and the upper side panel 20B and lies atop of the foam sheet 18. However, the top sheet 24 is provided with excess material, and so is "bloused". That is, the top sheet 24 lies loosely on the taut foam sheet 18 so that the central portion of the top sheet 24 can easily slide over the foam sheet 18 in response to movement of a patient.

Separating the upper 20B and lower 20A side panels is a zipper 26 having a size sufficient to permit the foam body 2 to be removed from the encasement member. The zipper goes completely around the mattress, with the exception of the head end (right side in FIG. 1), where the upper and lower panels are unitary.

In use, the foam body 2 is accessed using the zipper 26, exposing block bodies 14 and 16 which may be selectively added and removed so that the recesses 8 are limited to areas conforming to projecting parts, such as the heels and buttocks, of the particular patient who will be lying upon the mattress. The block bodies 14 and 16, which are not individually covered with any material, are held in place by the naturally high friction adhesion between adjacent open cell foam bodies, and the entire assembly of foam body 2 and foam sheet 18. Block bodies 14 and 16 may be reinserted into the encasement member, after which the zipper 26 is closed. The mattress can then be placed upon a conventional hospital bed frame without hindrance to the adjustability of the bed frame, since the entire mattress is formed of flexible material.

Upon the patient lying on the mattress, those projecting body portions which might otherwise be most subject to decubitus ulcers will lie on the top sheet 24 and the foam sheet 18 at positions over the unfilled recesses 8. As the individual sinks down into the mattress, the bloused top sheet 24 is able to slide on the underlying foam sheet 18 as the mattress distorts, and so does not apply shear stresses to the patient's skin.

The bloused top sheet 24 is a necessary condition for pressure relief due to the fact that the fabric of the top sheet sinks down into the recess left by the vacated cube. If the top sheet was taut (not bloused) a "trampoline" effect would exist above the cube recess, destroying the pressure relief properties of the mattress.

Moreover, the foam sheet 18 will tend to stretch to conform to the shape of the projecting body portions over the recess 8. It also aids in distributing body weight over a fairly wide area, rather than over small localized points, thereby reducing the pressure on the patient's skin and reduces any tendency for reductions in blood flow circulation. The patient will feel supported by the surrounding blocks and the foam sheet 18 and will not have a feeling of "sinking into a hole". The foam sheet 18 will also tend to distribute the area of support at the edges of the recess 8 so that the "cookie cutter effect" can be avoided.

Since the top sheet 24 is formed of a waterproof material, spills, perspiration and urine from the patient cannot seep into the mattress and create sanitation problems. The cleaning of the mattress can be performed simply by wiping off the top sheet 24. Moreover, heat dissipation occurs through the foam sheet 18, which acts as a plenum, to circulate air to the underlying portions of the mattress for removing heat from beneath the patient. Movements of the patient on the mattress creates a "bellows" effect by which air is circulated into and out of the encasement member, via the zipper 26.

The mattress of the present invention thus provides pressure relief for protruding portions of a patient's body, without the problems associated with the prior art, such as lack of cleanliness, lack of ventilation for heat dissipation and the dangers of shearing forces to a patient's skin. Moreover, the mattress of the present invention provides increased comfort without the feeling of "dropping into a hole" or the "cookie cutter effect".

Obviously, numerous modifications and variations of the present invention are possible in light of the above teachings. It is therefore to be understood that within the scope of the appended claims, the invention may be practiced otherwise than as specifically described herein.

What is claimed as new and desired to be secured by Letters Patent of the United States is:

1. A mattress comprising:

a first flexible and resilient body having a substantially flat top surface, said top surface having a plurality of recesses;

at least one flexible and resilient second body fittable in said at least one recess and being sized and shaped such that when fitted in said at least one recess, a surface of said second body is substantially coplanar with said substantially flat top surface, a number of said second bodies being fewer than that of said recesses such that at least open of said recesses is empty; and an encasement member encasing said first and second resilient bodies, said encasement member including a waterproof and flame retardart top sheet covering said top surface, and a flexible and resilient foam sheet positioned between said top surface and said top sheet and attached to said encasement member adjacent edges of said top surface, said top sheet being dimensioned with respect to said resilient foam sheet such that said top sheet is bloused when said resilient foam sheet is laid taut on said top surface, wherein said foam sheet has a thickness, density and ILD sufficient, when a patient is lying on said mattress, to avoid a feeling of falling into said empty recess and sufficient to avoid a cookie cutter effect around said empty recess.

2. The mattress of claim 1 wherein said top sheet has a lower friction coefficient than said top surface and is secured thereto by means for permitting a central portion of said top sheet to slide on said top surface.

3. The mattress of claim 1 wherein said first and second bodies are formed of firm foam and said resilient sheet is formed of soft foam.

4. The mattress of claim 3 wherein said recesses do not extend through the thickness of said first body, whereby said recesses have a bottom surface.

5. The mattress of claim 4 wherein said plurality of recesses are positioned. at locations corresponding to protruding body portions of a person lying on said mattress.

6. The mattress of claim 5 wherein said recesses and second bodies are substantially parallelepiped in shape.

7. The mattress of claim 6 wherein said first and second bodies are formed of polyurethane foam having 1.8 lb per cubic foot density and an ILD of 35, and wherein said resilient foam sheet is formed of polyurethane foam having 1.0 lb per cubic foot density and an ILD of 15.

8. The mattress of claim 1 wherein said encasement member includes fitting fabric panels covering at least sides of said first body lateral to said top surface, said top sheet and said resilient foam sheet also being attached to said panels adjacent lateral edges of said top surface.

9. The mattress of claim 8 including a zipper in at least one of said fabric panels and separating said at least one of said panels into upper and lower panels portions.

10. The mattress of claim 8 wherein said panels are formed of nylon reinforced vinyl.

11. The mattress of claim 1 wherein said waterproof and flame retardant sheet is also non-shearing and antibacterial.

12. The mattress of claim 11 wherein said waterproof, non-shearing, flame retardant and laminated to nylon or polyesters tricot, antibacterial top sheet is a 70 denier Nylon taffeta, treated with a flame retardant, fungicidal, waterproof urethane agent.

13. The mattress of claim 1 wherein said foam sheet is attached to said encasement member by sewing.

* * * * *

UNITED STATES PATENT AND TRADEMARK OFFICE

CERTIFICATE OF CORRECTION

PATENT NO. : 4,706,313

DATED : November 17, 1987

INVENTOR(S) : Mike Murphy

It is certified that error appears in the above-identified patent and that said Letters Patent is hereby corrected as shown below:

Column 2, line 21, change "air flow" to --airflow--.

Column 2, line 61, change "anti-bacterial" to --antibacterial".

Column 3, line 5, delete "has" (first occurrence).

Column 3, line 17, change "air tight" to --airtight--.

Column 3, line 18, after "example," insert --as--; same line, delete "and".

Column 5, line 35, change "Movements" to --Movement--.

Column 6, line 2, change "open" to --one--.

Column 6, line 6, change "retardart" to --retardant--.

Column 6, line 50, change "panels" to --panel--.

UNITED STATES PATENT AND TRADEMARK OFFICE

CERTIFICATE OF CORRECTION

PATENT NO. : 4,706,313

DATED : November 17, 1987

INVENTOR(S) : Mike Murphy

It is certified that error appears in the above-identified patent and that said Letters Patent is hereby corrected as shown below:

Column 6, line 50, change "panels" to -- panel --,

Signed and Sealed this

Eighth Day of November, 1988

*Attest:*

*Attesting Officer*

DONALD J. QUIGG

*Commissioner of Patents and Trademarks*